US009091285B2

(12) United States Patent
Pigg et al.

(10) Patent No.: US 9,091,285 B2
(45) Date of Patent: Jul. 28, 2015

(54) PISTON AND CYLINDER ASSEMBLY WITH AN INDICATOR PIN DEVICE

(75) Inventors: Mark Nicholas Pigg, Mount Pleasant, TN (US); Nitin G. Rao, Maharashtra (IN); Jerry Lee Walling, Jr., Spring Hill, TN (US)

(73) Assignee: Numatics, Incorporated, Novi, MI (US)

( * ) Notice: Subject to any disclaimer, the term of this patent is extended or adjusted under 35 U.S.C. 154(b) by 615 days.

(21) Appl. No.: 13/498,217

(22) PCT Filed: Nov. 22, 2010

(86) PCT No.: PCT/US2010/057595
§ 371 (c)(1),
(2), (4) Date: Mar. 26, 2012

(87) PCT Pub. No.: WO2011/063321
PCT Pub. Date: May 26, 2011

(65) Prior Publication Data

US 2012/0180654 A1 Jul. 19, 2012

(30) Foreign Application Priority Data

Nov. 23, 2009 (IN) ..... 2697/MUM/2009

(51) Int. Cl.
*F15B 15/28* (2006.01)

(52) U.S. Cl.
CPC ..... *F15B 15/28* (2013.01); *F15B 15/2807* (2013.01); *F15B 15/2892* (2013.01)

(58) Field of Classification Search
CPC ... F15B 15/28; F15B 15/2807; F15B 15/2892
USPC ..... 91/1; 92/5 R, 24, 26
See application file for complete search history.

(56) References Cited

U.S. PATENT DOCUMENTS

| | | | | |
|---|---|---|---|---|
| 859,843 | A | 7/1907 | Rogers | |
| 2,093,015 | A | 9/1937 | Madden | |
| 2,914,630 | A | 11/1959 | Ralston | |
| 3,171,916 | A | 3/1965 | Solski at al. | |
| 3,414,693 | A * | 12/1968 | Vandenburgh et al. | 200/82 R |
| 3,661,053 | A * | 5/1972 | Rich | 91/275 |
| 3,797,324 | A * | 3/1974 | Sheesley et al. | 74/99 R |
| 3,889,576 | A * | 6/1975 | Sheffer et al. | 91/44 |
| 3,997,887 | A | 12/1976 | Poynter | |

(Continued)

FOREIGN PATENT DOCUMENTS

| | | | |
|---|---|---|---|
| JP | 2007 333626 | A | 12/2007 |
| JP | 2008 223845 | A | 9/2008 |

(Continued)

OTHER PUBLICATIONS

Internat'l Search Report/Written Opinion of the Internat'l Search Authority, Internat'l Appln. No. PCT/US10/057595, Filing Date: Nov. 22, 2010; Mailing Date: Jul. 25, 2011, 12 p.

*Primary Examiner* — Thomas E Lazo
(74) *Attorney, Agent, or Firm* — Reising Ethington P.C.

(57) ABSTRACT

An indicator device for a piston and cylinder assembly has an indicator pin with a distal end indicator section for extending out of a side wall of a piston cylinder assembly when the piston and rod assembly is not at the end of its return stroke. A retracting device retracts the indicator pin when the piston and rod assembly moves to the end of its return stroke and has an optional internal lock that mechanically axially affixes the piston and rod assembly.

17 Claims, 5 Drawing Sheets

(56) References Cited

U.S. PATENT DOCUMENTS

| | | | | | |
|---|---|---|---|---|---|
| 4,207,564 | A | * | 6/1980 | Isakson et al. | 340/626 |
| 4,387,907 | A | * | 6/1983 | Hiestand | 279/4.02 |
| 4,413,549 | A | * | 11/1983 | Knable | 92/5 R |
| 4,524,676 | A | * | 6/1985 | Rogers | 91/43 |
| 4,569,365 | A | * | 2/1986 | Namand et al. | 137/554 |
| 4,679,452 | A | * | 7/1987 | Stoll | 74/110 |
| 4,751,867 | A | | 6/1988 | Johansson et al. | |
| 4,754,694 | A | * | 7/1988 | Martin | 92/5 L |
| 4,784,037 | A | * | 11/1988 | Fabyan et al. | 91/43 |
| 5,244,004 | A | | 9/1993 | Robertson | |
| 5,488,860 | A | * | 2/1996 | Speck et al. | 73/168 |
| 5,522,303 | A | * | 6/1996 | Stoll et al. | 92/27 |
| 5,906,222 | A | * | 5/1999 | Faulstich | 137/554 |
| 7,299,739 | B2 | * | 11/2007 | Nakata et al. | 92/15 |
| 7,757,547 | B2 | | 7/2010 | Kageyama et al. | |
| 2006/0032396 | A1 | | 2/2006 | Herzog et al. | |
| 2007/0186767 | A1 | * | 8/2007 | Staudinger et al. | 92/5 R |
| 2009/0266228 | A1 | * | 10/2009 | Teschke et al. | 92/24 |

FOREIGN PATENT DOCUMENTS

| | | | |
|---|---|---|---|
| KR | 2002 0012139 | A | 2/2002 |
| KR | 2009 0012166 | A | 2/2009 |
| KR | 2009 0017848 | A | 2/2009 |

* cited by examiner

PISTON AND CYLINDER ASSEMBLY WITH AN INDICATOR PIN DEVICE

TECHNICAL FIELD

The field of this invention relates to a cylinder and piston device with an indicator that is actuated when the piston rod and piston assembly is at the end of its return stroke in the cylinder and a locking mechanism.

BACKGROUND OF THE DISCLOSURE

Pressure cylinders have long been used to move other mechanical devices such as arms and doors. The piston and piston rod assembly is pneumatically powered and reciprocally strokes between an extended forward position and a retracted return position. One such device is used to open and close sliding doors on the hopper of a coal car for the railroad industry.

When the car door is closed, a yard operator often visually inspects under the coal car door to assure that it is in the fully closed and locked position. While many power cylinders have indicator systems that engage a switch that can actuate an electric signal, the signal indicator may be remote from the cylinder and not visible for easy inspection by the yard operator. Furthermore, known cylinders do not have a secondary internal lock.

What is desired is a power cylinder that can provide an indicator pin at the side wall of the cylinder that extends out to provide a visible indication when the power cylinder is not at the end of a return stroke and retracts when the power cylinder is at the end of the return stroke. What is also needed is a locking pin that mechanically secures the power cylinder at the end of the return stroke.

SUMMARY OF THE DISCLOSURE

In accordance with one aspect of the invention, a piston and cylinder assembly has a cylinder housing and a piston and rod assembly slidably mounted in the cylinder housing. A piston rod extends through one end of the cylinder housing. A second end of the cylinder housing has an indicator pin resiliently biased to an extended position with a distal section that extends outwardly from an exterior surface of the cylinder housing. The indicator pin operably is connected with a retracting device mounted within the cylinder housing. The retracting device is engagable with the piston and rod assembly to retract the indicator pin from its extended position to a retracted position when the piston and rod assembly moves to the end of a return stroke. The retracting device preferably provides an operating canted surface that is engaged between the pin and piston rod and retracts the pin radially inward with respect to the cylinder as the piston and rod assembly moves to the end of its return stroke.

Preferably, the indicator pin is connected to a central ring section with an aperture therethrough. The piston and rod assembly has a tapered end aligned to abut an inner periphery of the ring at an edge of the aperture to retract the ring from its extended position as it moves to the return position. In another embodiment, the tapered end may engage a wedge member affixed with the pin.

In one embodiment, the central ring section has a plunger rod and a spring seat extending in an opposite direction from the distal section of the indictor pin. The plunger rod slidably passes into a cage that houses a spring member. The spring member biases the plunger rod and indicator pin toward the extended position against the retracting motion caused by the tapered interior end of the piston and rod assembly. The cylinder housing preferably has a cylindrical side wall section and an end cap member. The end cap member mounts the indicator pin, the retracting device, and the spring member. The indicator pin protrudes out the side of the end cap.

In another embodiment, the indicator pin is operably connected to a lever, e.g. a bell crank that is pivotably mounted to the cylinder housing. The lever has a first leg section engagable by the piston and rod assembly to pivot the lever and retract the indicator pin. The lever has a section operably connected to the indicator pin. In one embodiment, the section is a second leg connected to the indicator pins. In another embodiment, the section is a cam surface abutting a follower pin affixed to the indicator pin.

In accordance with another aspect of the invention, an end cap assembly is mounted on an end of a cylinder and piston assembly. The end cap assembly has an indicator pin biased to extend through an aperture in the end cap and protrudes beyond an exterior surface of the end cap. The indicator pin is operably connected to a retracting device mounted to an interior section of the end cap assembly. The retracting device is constructed to be operably engaged against a piston rod assembly to retract the indicator pin into the aperture.

Preferably, the aperture is positioned about a periphery of the end cap and the pin extends out of the aperture at the periphery.

In accordance with another aspect of the invention, a piston and cylinder assembly has a piston and rod assembly dividing the cylinder housing into varying sized first and second pressure chambers. The first pressure chamber surrounds the piston rod axially from the piston to one end of the housing and the second pressure chamber extends from an opposite side of the piston to a second end of the housing.

The piston and rod assembly has an extension extending into the second pressure chamber. The extension has a tapered interior end and the extension has a recess between axially spaced walls. A locking pin is mounted to the cylinder housing for extending into the second pressure chamber and movable between a radially inner position where it engages the recess in the extension and mechanically locks the piston and rod assembly in the retracted position and a radially outer position where it disengages from the extension and allows the piston and rod assembly to axially move.

Preferably, the locking pin is spring biased to the radially inner position and responsive to pneumatic pressure within the second chamber above a predetermined amount to move radially outward against the spring bias.

BRIEF DESCRIPTION OF THE DRAWINGS

Reference now is made to the accompanying drawings in which.

DETAILED DESCRIPTION OF THE PREFERRED EMBODIMENT

Figure 1:
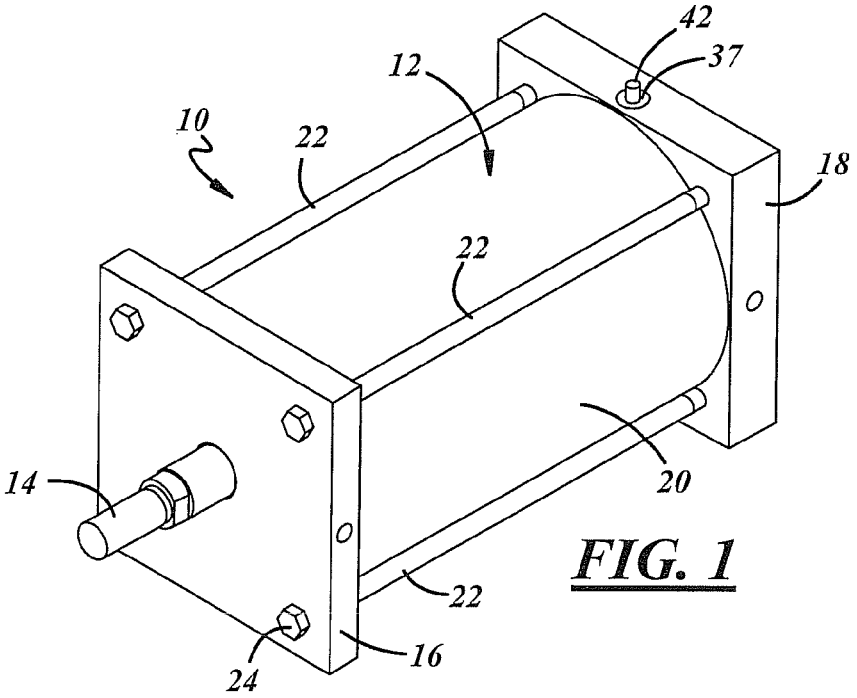
FIG. 1 is a perspective view of a power piston and cylinder assembly in accordance with one embodiment of the invention.
Figure 2:
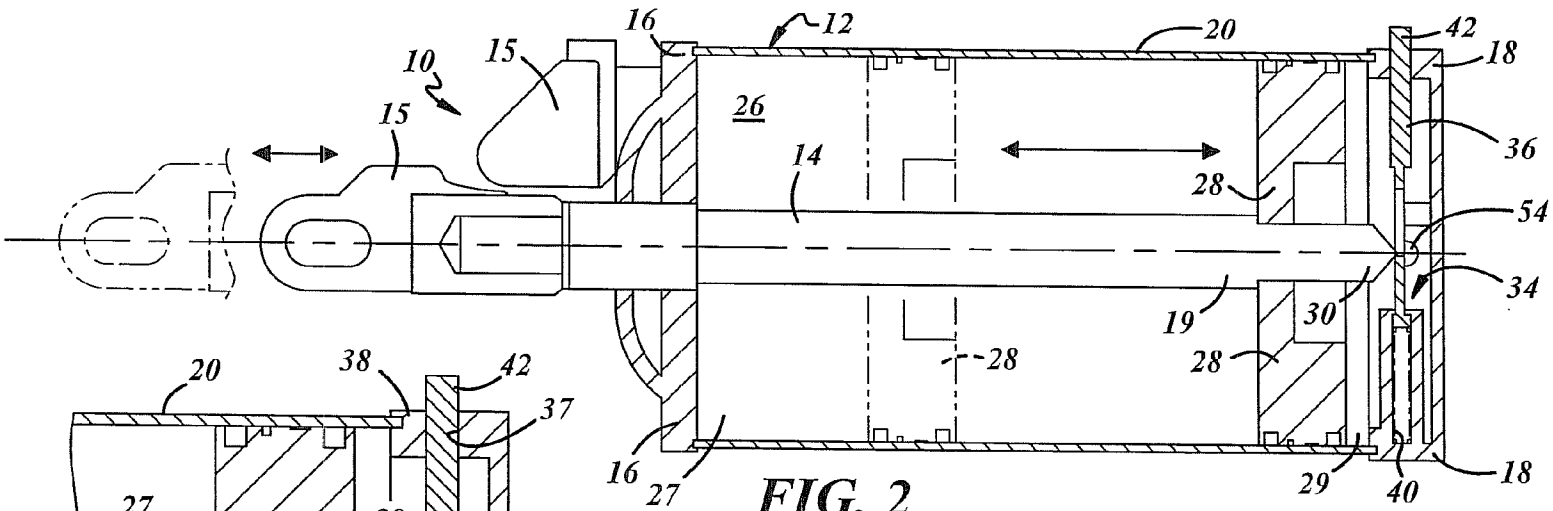
FIG. 2 is a side segmented view of the piston and cylinder assembly shown in FIG. 1.

Referring now to FIGS. 1 and 2, a power piston and cylinder assembly 10 has an outer cylinder housing 12 with a piston and rod assembly 14 extending from one end. The power piston and cylinder assembly 10 may have suitable brackets 15 to be mounted to a railroad hopper car door or other device.

The cylinder housing 12 has two end caps 16 and 18 mounted at each end of a central cylinder wall 20 and are held together mounted together with elongated pins 22 and nuts 24. As shown in FIG. 2, the piston and rod assembly 14 has rod 19 extending through the interior 26 of the cylinder 12 and is fixedly connected to a piston 28 that slides within the interior 26 of cylinder and divides the interior into two varying sized pressure chambers 27 and 29. As more clearly shown in FIG. 3, the piston rod 19 has an extension 30 with a tapered end 32 with a canted surface 33 that extends beyond the piston 28.

A retracting indicator device 34 is mounted in the end cap 18 and engages the piston rod extension 30. The retracting indicator device 34 provides a visual indication to an operator whether or not the piston rod 19 is at the end of its return stroke.

Figure 3:
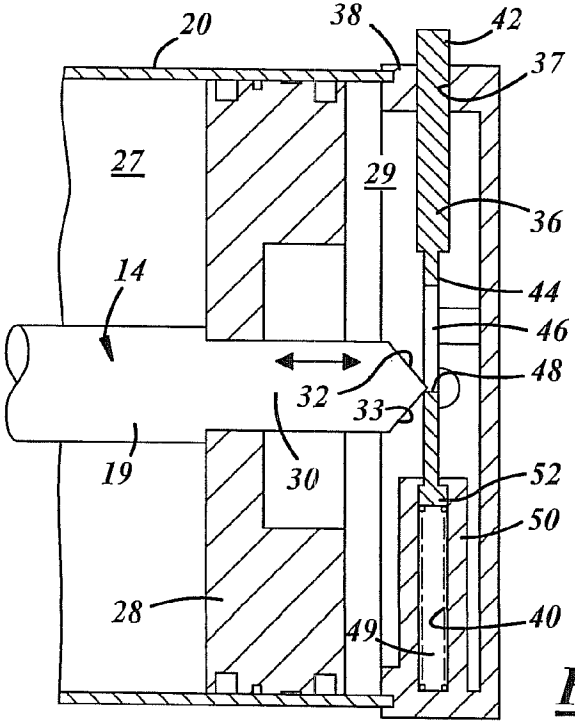
FIG. 3 is an enlarged fragmentary and segmented view of one end of the piston and cylinder assembly shown in FIG. 2 with the indicator pin in an extended protruding position to indicate that the piston and piston rod assembly is not at the end of its return stroke.

The retracting indicator device 34 has a pin member 36 extending through an aperture 37 in the side wall 38 of the end cap 18. The pin member 36 is biased by a spring 40 to the extended position as shown in FIGS. 2 and 3 where the distal section 42 of the pin 36 extends beyond the side wall 38 and visibly protrudes radially outward. The distal section 42 may be colored red or some other highly visible and/or fluorescent color to emphasize a clear visual indication that it is protruding out of the end cap 18.

Figure 4:
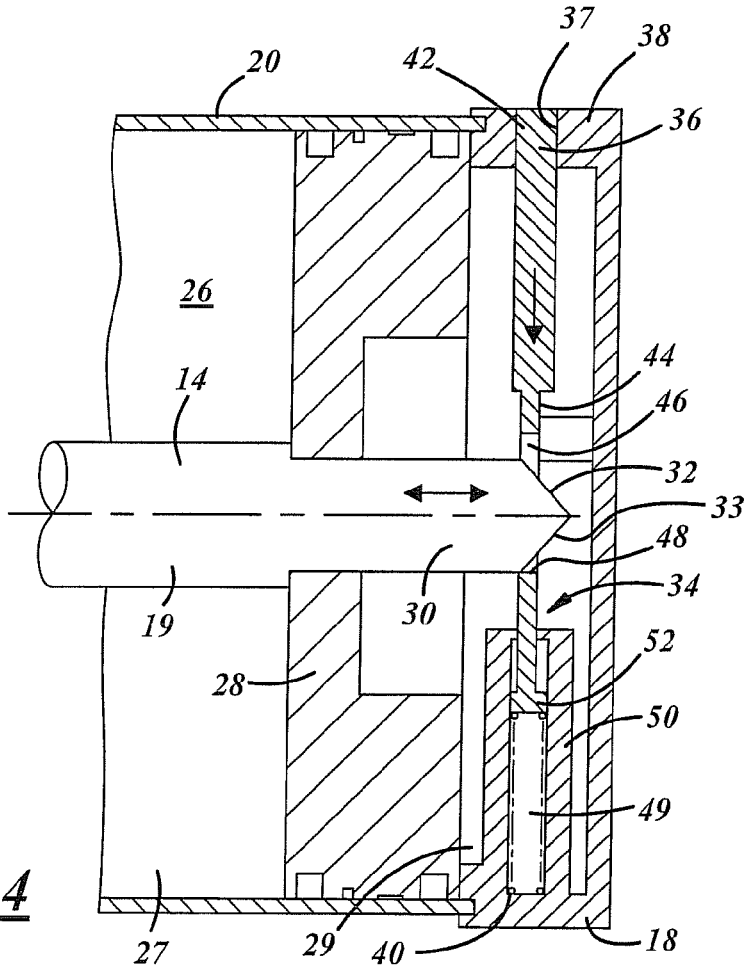
FIG. 4 is a view similar to FIG. 3 with the indicator pin recessed to indicate that the piston and piston rod assembly is at the end of its return stroke.

The mid-section 44 of the pin member has a ring shape with an aperture 46 that is positioned such that its lower edge 48 engages the canted surface 33 of tapered end 32 of the piston rod 30. When the piston and rod assembly moves to the end of its return stroke to the right as shown in the drawings, the piston tapered end 32 passes through the aperture 36, canted surface 33 pulls down on edge 48, and the pin member 36 is forced downwardly against the spring bias to a position shown in FIG. 4. Preferably, the distal pin section 42 then becomes flush or even recessed within aperture 37.

When the piston is moved in an opposite direction to the left as shown in the FIGS. 1-4, the withdrawal of the tapered end 32 allows the spring 40 to resiliently bias the pin member upward and allows the distal section 42 to again protrude visibly through the aperture 37. The spring 40 may be a coil type that is retained in a bore 49 of cage 50 through which pin member has a lower plunger and spring seat 52 seated against the spring member 40. The pin member 36 is supported by both aperture 37 and cage 50 against any side torque presented when tapered surface 32 engages against the edge 48.

While an aperture 46 is described for the first embodiment, the aperture 46 may be replaced by a notch or c-shape of mid-section 44. The operative edge 48 may exist in other shapes to engage the tapered end 32 of the piston rod. The operative edge 48 may be a canted surface of a wedge ring that engages a wedge nut mounted on the end of piston rod. Other complementary shaped surfaces on the pin and rod are also possible for example, a cam surface and cam follower.

Figure 7:
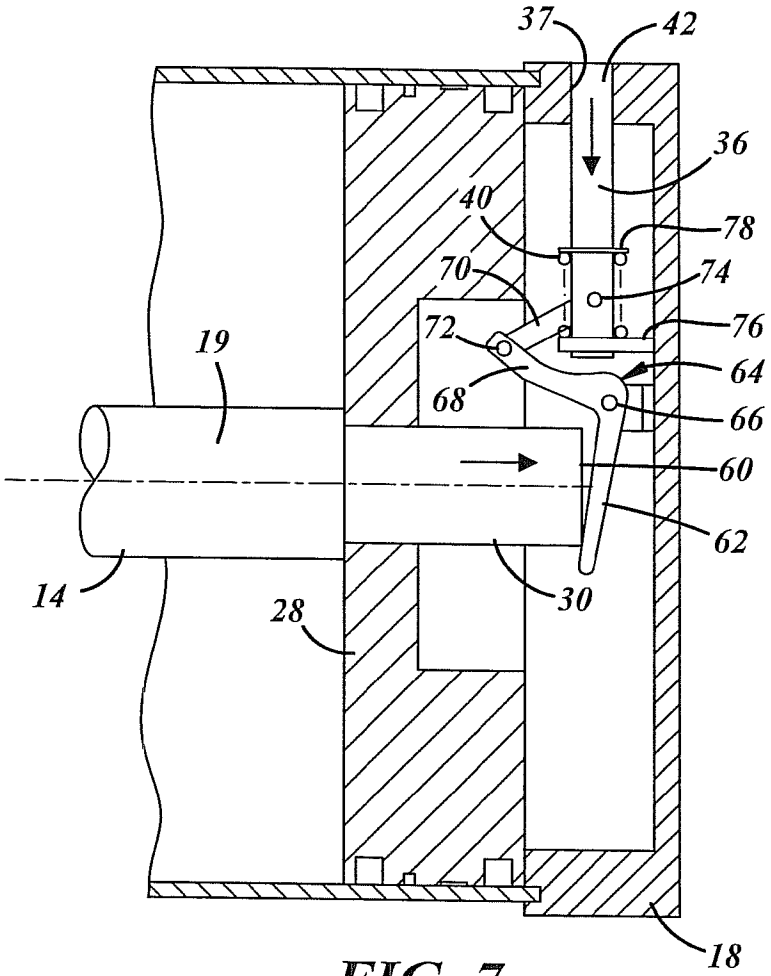
FIG. 7 is a view similar to FIG. 6 showing the piston and piston rod assembly at the end of its return stroke.
Figure 6:
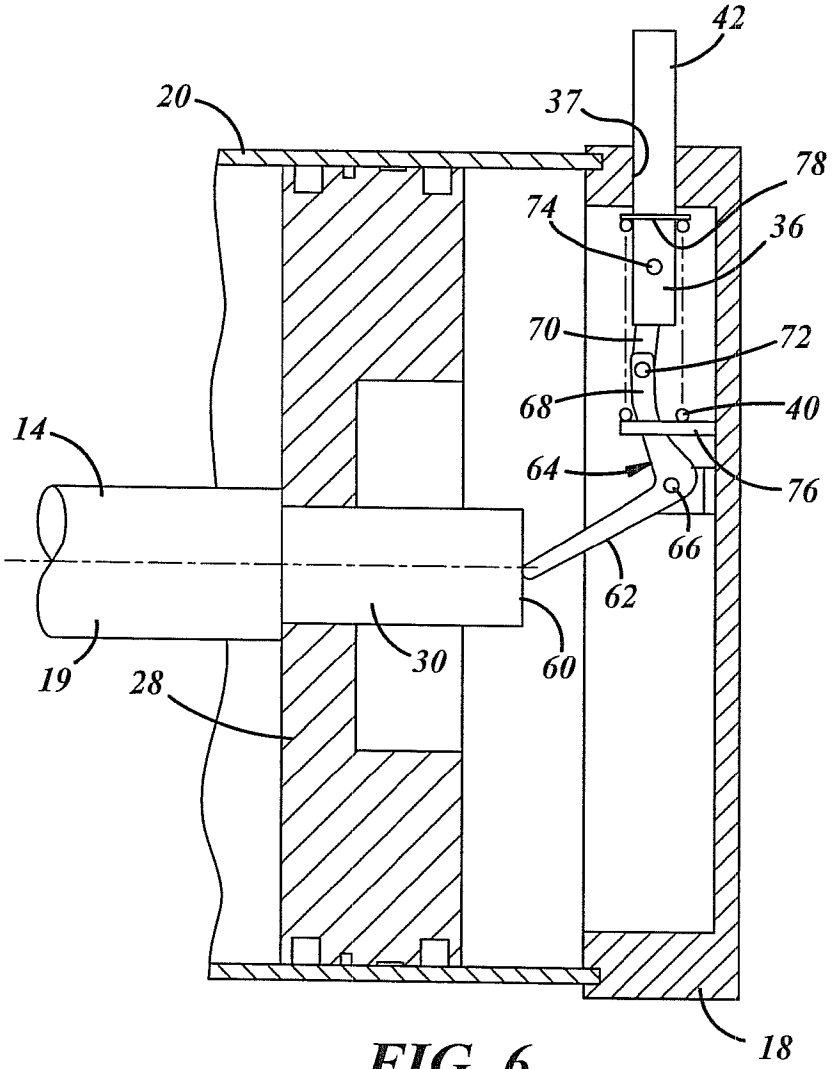
FIG. 6 is a side segmented view of an alternate embodiment showing the piston and piston rod assembly not at the end of its return stroke.

Another embodiment is shown in FIGS. 6 and 7 that discloses a piston rod 14 with an extension 30 having a flat end 60. Similar parts are numbered the same as with the first embodiment to indicate corresponding parts. The flat end 60 can engage a first lever leg 62 of a bell crank 64 that is pivotably connected to the end cap 18 at pivot point 66. The bell crank 64 has a second lever leg 68 that is pivotably connected to a linkage member 70 at pivot point 72. The linkage member 70 has another end pivotably connected to pin member 36 at point 74. The pin member 36 extends through aperture 37 in the end cap 18 with distal section 42 biased to extend radially outward of the side wall as shown in FIG. 6. A coil spring member 40 extends between a spring seat 76 affixed to end cap 18 and a collar 78 affixed about pin member 36.

When the piston and rod assembly 14 moves to the end of its return stroke, the flat end 60 engages and pushes on first lever leg 62 to cause the pivoting of the bell crank 64. The second leg 68 pivots and moves link 70 to pull down on the pin member to cause the pin member to retract from the position shown in FIG. 6 to the position shown in FIG. 7. On the other hand, when the piston and rod assembly is moved to the left as shown in FIGS. 6 and 7, the spring biases the pin upwardly and allows it to protrude through the aperture 37 and resets the bell crank 68 to the position shown in FIG. 6.

Figure 9:
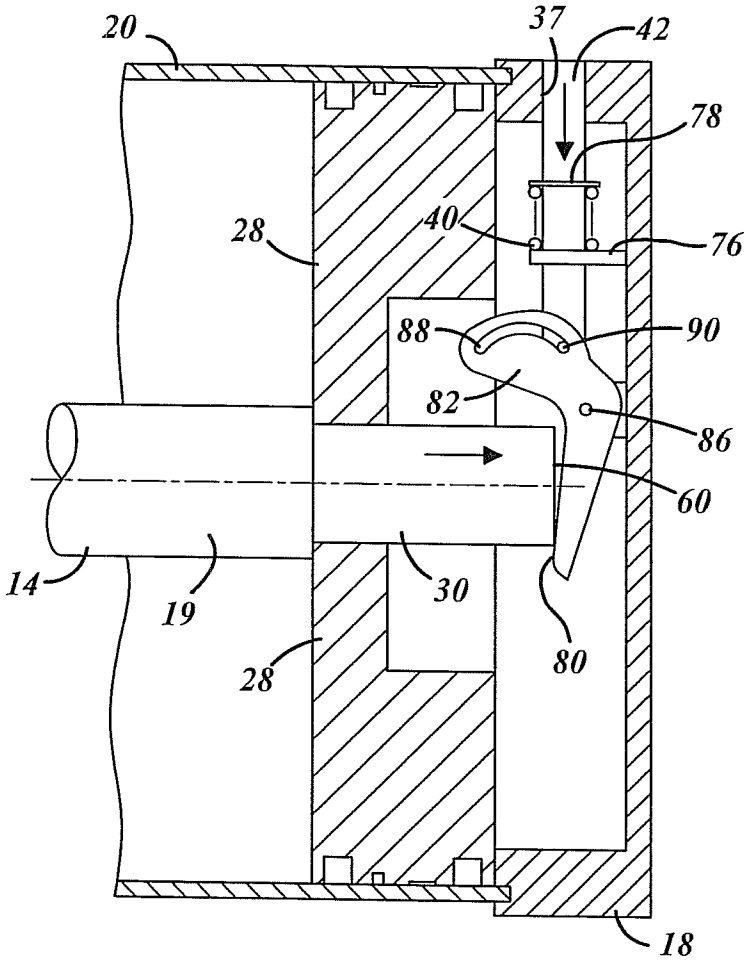
FIG. 9 is a view similar to FIG. 8 showing the piston and piston rod assembly at the end of its return stroke.
Figure 8:
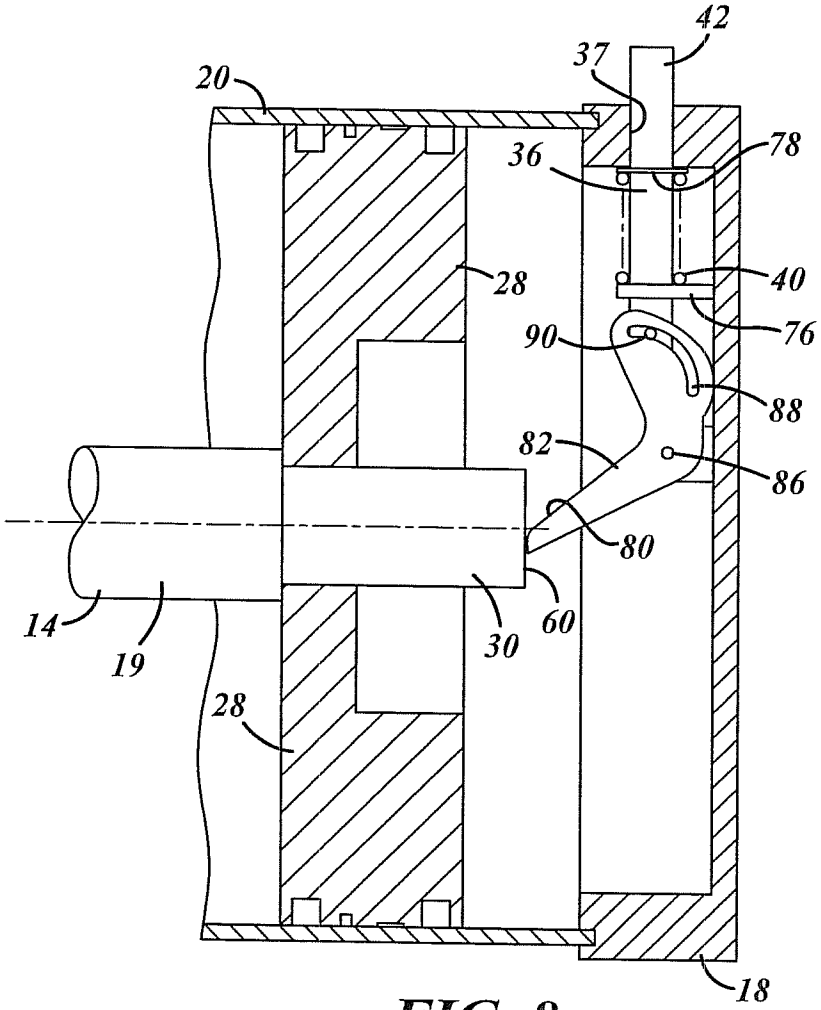
FIG. 8 a side segmented view of a third embodiment showing the piston and piston rod assembly not at the end of its return stroke.

A third embodiment is shown in FIGS. 8 and 9 where the flat end 60 of the piston rod can engage a lever leg 80 of a cam member 82. The cam member 82 is pivotably connected to the end cap 18 at pivot point 86. The cam member 82 has a cam slot 88 that engages a follower pin 90 connected to the pin member 36. The pin member 36 extends through aperture 37 in the end cap 18 with distal section 42 extending radially outward of the side wall as shown in FIG. 6. A coil spring member 40 extends between a spring seat 76 affixed to end cap 18 and a collar 78 affixed about pin member 36.

When the piston and rod assembly 14 moves to the end of its return stroke, the flat end 60 engages and pushes on lever leg 80 to cause the cam member 82 to pivot. Slot 88 rotates and is curved such that it pulls down on follower pin 90 which in turn pulls down on pin 36 to retract the distal section 42 from the position shown in FIG. 8 to the position shown in FIG. 9. On the other hand, when the piston rod is moved to the left as shown in FIGS. 8 and 9, the spring 40 resiliently biases the pin upwardly and allows it to protrude through the aperture 37 and resets the cam member 82 to the position shown in FIG. 8.

Figure 5:
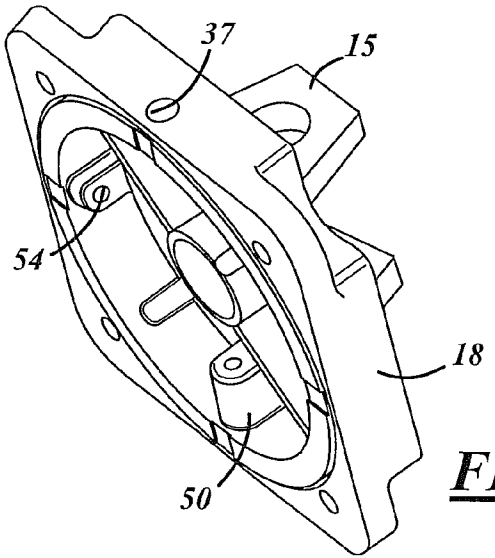
FIG. 5 is a view of the end cap shown in FIG. 2.

The end cap as more explicitly shown in FIG. 5 has the standard pressure inlet 54 and sealing groove 94 for connection to the side cylinder wall 20. If the indicator device 34 needs replacement, the entire end cap may be replaced with a new end cap 18 that has an indicator device 34 already mounted therein.

Figure 11:
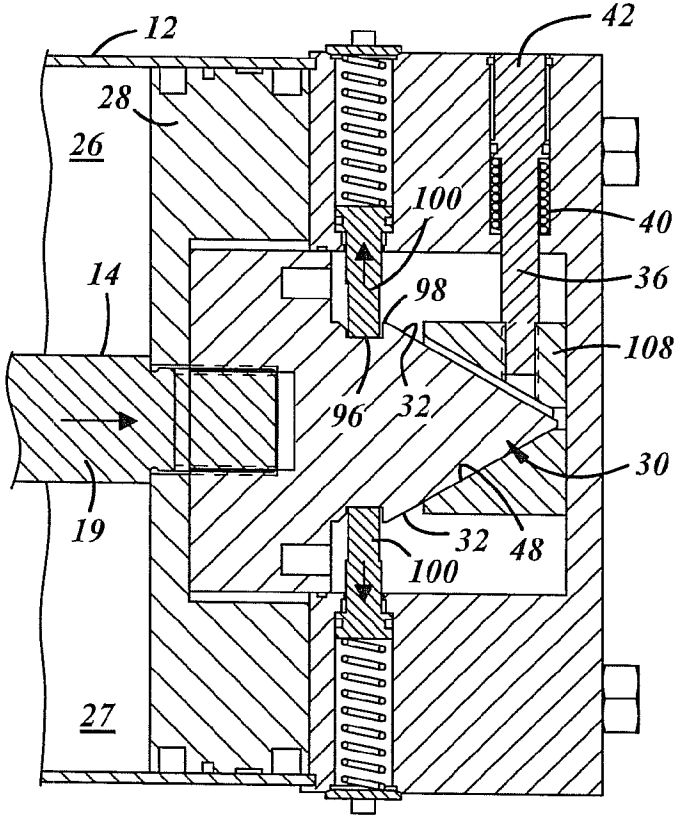
FIG. 11 is a view similar to FIG. 10 showing the piston and piston rod assembly at an intermediate position with the locking pin in the disengaged position (in solid) and in an engagable position (in phantom).
Figure 10:
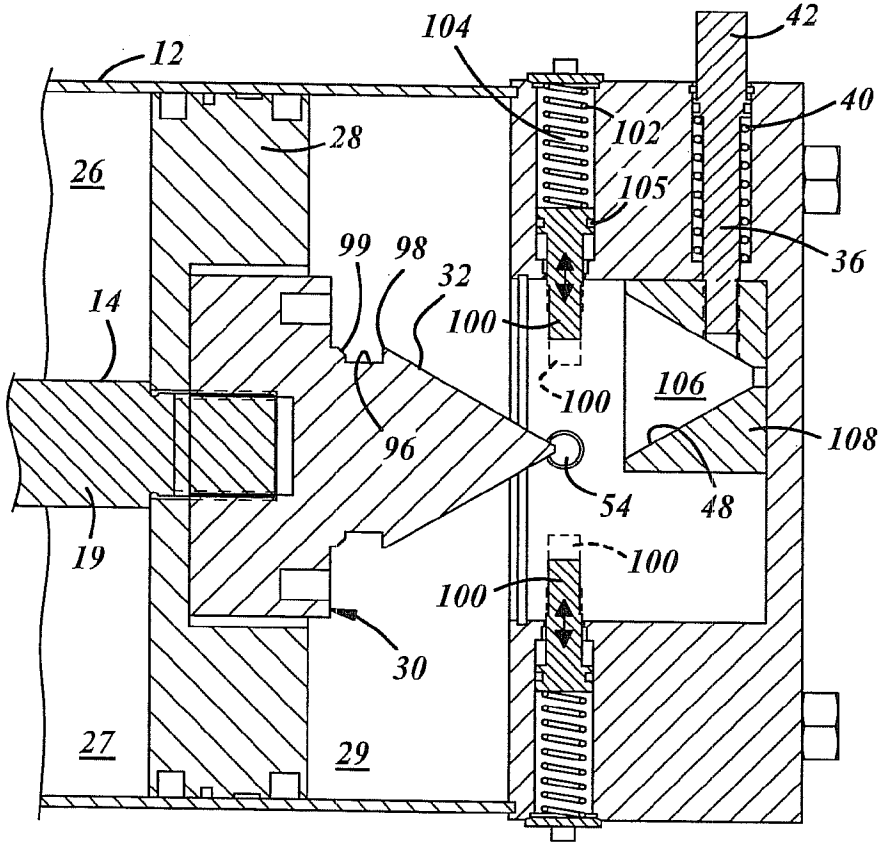
FIG. 10 is a side segmented view of a fourth embodiment showing the piston and piston rod assembly at the end of its return stroke that also has a locking pin.

A fourth embodiment is shown in FIGS. 10 and 11 where a separate extension 30, also referred to as a spud, is threadably engaged to the piston rod 19 and assists in fixing the piston 28 onto the piston and rod assembly 14. The extension 30 is provided with a groove or recess 96 between two proximate walls 98, 99 or shoulders of tapered end 32.

Two opposing lock pins 100 are mounted in the end cap 18 for moving between a radially outer position shown in solid lines and a radially inner position shown in phantom in FIG. 10 and in solid in FIG. 11. A mounted coil spring 102 housed in bore 104 of end cap 18 biases the lock pins to the radially inner position. The pneumatic pressure within chamber 29 above a predetermined amount pushes against the radially inner side of the lock pin to move it radially outwardly by overcoming the bias of the coil spring 102. The outer end of bore 104 is vented to the ambient exterior. Each lock pin 100 is sealingly fitted within a respective bore 104 by a seal 105 to prevent pneumatic pressure from leaking therethrough, but provides for sliding motion within bore 104.

The tapered end 32 of extension 30 may be generally conical in shape and engage operative edge 48 which is part of a conical recess 106 in a block 108 attached to indicator pin member 36. The pin member 36 and block 108 work in the same fashion as the pin member 36 in the first embodiment.

Referring particularly to FIG. 11, when the pin member 36 is fully retracted to show the piston rod is in a full return position, the lock pin 100 becomes axially aligned with groove or recess 98 and is resiliently biased to engage therein. This engagement provides a mechanical lock against any undesired pull forces to extend rod 19 and assures that the rod 19 and piston 28 are retained in the full return position.

When extension of the rod is desired, pneumatic pressure is introduced into chamber 29 and the pressure is exerted on the radially inner position of the lock pins 100 to automatically release the lock pins 100 against the bias of coil spring 102. The pneumatic pressure, in chamber 29 needed to unlock the pins, for example 30 p.s.i., is lower than the pneumatic pressure needed to extend the piston and rod assembly, for example 40 p.s.i. With pneumatic pressure being introduced into chamber 29, lock pins 100 are first disengaged and then the piston and rod assembly 14 are moved as shown in FIG. 10. The lock pins 100 remain in the radially outer disengaged position, as shown in FIG. 10, until pneumatic pressure in chamber 29 is released. When the pneumatic pressure is released, the lock pins 100 move radially inward as shown in phantom in FIG. 10, and ready to engage the groove or recess 98 when the piston and rod assembly 14 fully completes the return stroke. As the extension 10 engages the pin 100, the pin rides on the tapered surface 32 and resiliently snaps into the recess 96 when recess 96 becomes aligned with the pins 100 to lock the piston and rod assembly 14 in place.

Other variations and modifications are possible without departing from the scope and spirit of the present invention as defined by the appended claims.

The embodiments in which an exclusive property or privilege is claimed are defined as follows:

1. A piston and cylinder assembly comprising:

a cylinder housing;

a piston and rod assembly slidably mounted in said cylinder housing and having a piston rod extending through one end of said cylinder housing;

a second end of said cylinder housing having an indicator pin normally resiliently biased to an extended position where the indicator pin has a distal section that extends outwardly from an exterior surface of said cylinder housing to be exposed and visible from an exterior of said piston and cylinder assembly;

a spring element engaged with said indicator pin for resiliently biasing said indicator pin to an extended position;

said indicator pin operably connected with a retracting device mounted within said cylinder housing; and said retracting device being engagable with said piston and rod assembly to retract said indicator pin against the bias of said spring element from its extended position to a retracted position when said piston and rod assembly is at an end of its return stroke.

2. A piston and cylinder assembly as defined in claim 1 further comprising:

said piston and rod assembly dividing said cylinder housing into varying sized first and second pressure chambers with said first pressure chamber surrounding said piston rod from said piston to said one end of said cylinder housing and said second pressure chamber extending from an opposite side of said piston to a second end of said cylinder housing;

said piston and rod assembly having an extension extending into said second pressure chamber;

one of said piston rod and said extension having a recess between axially spaced walls;

a locking pin mounted to said cylinder housing for extending into one of said pressure chambers and movable between a radially inner position where it engages said recess in an axially fixed position and mechanically locks said piston and rod assembly against axial motion and a radially outer position where it disengages and allows said piston and rod assembly to axially move; and said locking pin being spring biased to said radially inner position and responsive to pressure above a predetermined amount in one of said pressure chambers when in said radially inner position to move radially outward against said spring bias.

3. A piston and cylinder assembly comprising:

a cylinder housing;

a piston and rod assembly slidably mounted in said cylinder housing and having a piston rod extending through one end of said cylinder housing;

a second end of said cylinder housing having an indicator pin normally resiliently biased to an extended position where the indicator pin has a distal section that extends outwardly from an exterior surface of said cylinder housing;

said indicator pin operably connected with a retracting device mounted within said cylinder housing;

said retracting device being engagable with said piston and rod assembly to retract said indicator pin from its extended position to a retracted position when said piston and rod assembly is at an end of its return stroke; and one of said retracting device and said piston and rod assembly having a canted surface engagable with the other of said retracting device and said piston and rod assembly to retract said piston rod radially inwardly against its normally resilient bias toward a radially extended position when said piston and rod assembly is moved to the end of its return stroke.

4. A piston and cylinder assembly as defined in claim 3 further comprising:

said indicator pin connected to a central ring section with aperture therethrough; and said piston and rod assembly having a tapered interior end aligned to abut an inner periphery of said ring at an edge of said aperture to retract said indicator pin from its radially extended position to its radially retracted position when said piston and rod assembly is moved to the end of the return stroke.

5. A piston and cylinder assembly as defined in claim 4 further comprising:

a plunger rod and spring seat extending from said central ring section in an opposite direction from said distal section of the indictor pin from said central ring and extending in a bore of a cage; and a spring member housed in said bore of said cage and resiliently biases the indicator pin toward the extended position against the retracting motion caused by said tapered interior end of said piston and rod assembly.

6. A piston and cylinder assembly as defined in claim 5 further comprising:

said cylinder housing having a cylindrical side wall section and an end cap member; and said end cap member mounting said indicator pin and said retracting device and said spring member.

7. A piston and cylinder assembly as defined in claim 6 further comprising:

said indicator pin protruding out of a cylindrical side of said end cap.

8. A piston and cylinder assembly as defined in claim 7 further comprising:

said piston and rod assembly dividing said cylinder housing into varying sized first and second pressure chambers with said first pressure chamber surrounding said piston rod from said piston to said one end of said cylinder housing and said second pressure chamber extending from an opposite side of said piston to said second end;

said piston and rod assembly having an extension extending into said second pressure chamber;

said tapered interior end being a part of said extension;

said extension having a recess between axially spaced walls; and a locking pin mounted to said cylinder housing for extending into said second pressure chamber and movable between a radially inner position where it engages said recess in said extension and mechanically locks said piston and rod assembly in said retracted position and a radially outer position where it disengages from said extension and allows said piston and rod assembly to axially move.

9. A piston and rod assembly as defined in claim 8 further comprising:

said locking pin being spring biased to said radially inner position and responsive to pressure within said second chamber above a predetermined amount to move radially outward against said spring bias.

10. A piston and cylinder assembly as defined in claim 3 further comprising:

said cylinder housing having a cylindrical side wall section and an end cap member; and said end cap member mounting said indicator pin and said retracting device.

11. A piston and cylinder assembly comprising:

a cylinder housing;

a piston and rod assembly slidably mounted in said cylinder housing and having a piston rod extending through one end of said cylinder housing;

a second end of said cylinder housing having an indicator pin normally resiliently biased to an extended position where the indicator pin has a distal section that extends outwardly from an exterior surface of said cylinder housing;

said indicator pin operably connected with a retracting device mounted within said cylinder housing; and said retracting device being engagable with said piston and rod assembly to retract said indicator pin from its extended position to a retracted position when said piston and rod assembly is at an end of its return stroke;

said piston and rod assembly dividing said cylinder housing into varying sized first and second pressure chambers with said first pressure chamber surrounding said piston rod from said piston to said one end of said cylinder housing and said second pressure chamber extending from an opposite side of said piston to said second end;

said piston and rod assembly having an extension extending into said second pressure chamber;

said tapered interior end being a part of said extension;

said extension having a recess between axially spaced walls; and a locking pin mounted to said cylinder housing for extending into said second pressure chamber and movable between a radially inner position where it engages said recess in said extension and mechanically locks said piston and rod assembly in said retracted position and a radially outer position where it disengages from said extension and allows said piston and rod assembly to axially move.

12. A piston and rod assembly as defined in claim 11 further comprising:

said locking pin being spring biased to said radially inner position and responsive to pressure within said second chamber above a predetermined amount to move radially outward against said spring bias.

13. A piston and cylinder assembly comprising:

a cylinder housing;

a piston and rod assembly slidably mounted in said cylinder housing and having a piston rod extending through one end of said cylinder housing;

a second end of said cylinder housing having an indicator pin normally resiliently biased to an extended position where the indicator pin has a distal section that extends outwardly from an exterior surface of said cylinder housing;

said indicator pin operably connected with a retracting device mounted within said cylinder housing; and said retracting device being engagable with said piston and rod assembly to retract said indicator pin from its extended position to a retracted position when said piston and rod assembly is at an end of its return stroke;

said cylinder housing having a cylindrical side wall section and an end cap member; and said end cap member mounting said indicator pin and said retracting device.

14. A piston and cylinder assembly comprising:

a cylinder housing;

a piston and rod assembly slidably mounted in said cylinder housing and having a piston rod extending through one end of said cylinder housing;

a second end of said cylinder housing having an indicator pin normally resiliently biased to an extended position where the indicator pin has a distal section that extends outwardly from an exterior surface of said cylinder housing;

said indicator pin operably connected with a retracting device mounted within said cylinder housing; and said retracting device being engagable with said piston and rod assembly to retract said indicator pin from its extended position to a retracted position when said piston and rod assembly is at an end of its return stroke;

said indicator pin operably connected to a lever pivotably mounted to said cylinder housing; and said lever having a first leg section engagable by said piston and rod assembly and a section operably connected to said indicator pin.

15. A piston and cylinder assembly as defined in claim 14 further comprising:

wherein said lever is a bell crank.

16. An end cap assembly for mounting on an end of a cylinder and piston assembly, said end cap assembly comprising:

a spring element engaged to an indicator pin for resiliently biasing said indicator pin to an extended position;

said indicator pin normally biased to extend through an aperture in the end cap and protruding beyond an exterior surface of said end cap;

said indicator pin operably connected to a retracting device mounted to an interior section of said end cap assembly; and said retracting device constructed to be operably engaged against said piston assembly to retract said indicator pin against the bias of said spring element into said aperture.

17. An end cap assembly as defined in claim 16 further comprising:

said aperture being positioned about a periphery of said end cap; and said pin extending out of said aperture at said periphery.

* * * * *